US008336305B2

(12) United States Patent
Matsuura et al.

(10) Patent No.: US 8,336,305 B2
(45) Date of Patent: Dec. 25, 2012

(54) HYDRAULIC DRIVE DEVICE AND WORKING MACHINE WITH THE SAME

(75) Inventors: Yuuji Matsuura, Kobe (JP); Naoki Sugano, Kobe (JP); Takao Nanjo, Kobe (JP); Hiroshi Togo, Hiroshima (JP); Hidekazu Oka, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 912 days.

(21) Appl. No.: 12/447,347

(22) PCT Filed: Nov. 26, 2007

(86) PCT No.: PCT/JP2007/072730

§ 371 (c)(1), (2), (4) Date: Apr. 27, 2009

(87) PCT Pub. No.: WO2008/065983

PCT Pub. Date: Jun. 5, 2008

(65) Prior Publication Data

US 2010/0089049 A1 Apr. 15, 2010

(30) Foreign Application Priority Data

Nov. 28, 2006 (JP) ..... 2006-320047

(51) Int. Cl.
*F15B 21/14* (2006.01)
*E02F 9/22* (2006.01)

(52) U.S. Cl. ..... 60/419; 60/445

(58) Field of Classification Search ..... 60/419, 60/445

See application file for complete search history.

(56) References Cited

U.S. PATENT DOCUMENTS

2003/0221339 A1* 12/2003 Naruse et al. ..... 37/348

FOREIGN PATENT DOCUMENTS

JP 10-152866 6/1998
JP 2003 120616 4/2003

(Continued)

OTHER PUBLICATIONS

Office Action issued Aug. 23, 2011 in Japanese Application No. 2006-255788 (With English Translation).

(Continued)

*Primary Examiner* — Thomas E Lazo

(74) *Attorney, Agent, or Firm* — Oblon, Spivak, McClelland, Maier & Neustadt, L.L.P.

(57) ABSTRACT

A hydraulic drive device capable of utilizing return oil effectively while maintaining a driven speed of a hydraulic actuator, as well as a working machine having the hydraulic drive device, are provided. The hydraulic drive device includes a controller. During an external force applying period in which a return oil pressure exceeds a discharge pressure from a hydraulic pump, the controller specifies a regenerating flow rate capable of being conducted to a regeneration oil passage and a surplus flow rate other than the regenerating flow rate on the basis of power required of the hydraulic pump out of return oil other than return oil which is conduced to a tank through a control valve, then conducts the return oil of the regenerating flow rate to the regeneration oil passage and controls an MO valve and a regulator so that the return oil of the surplus flow rate is conducted to an outlet oil passage.

14 Claims, 10 Drawing Sheets

FOREIGN PATENT DOCUMENTS

| | | | |
|---|---|---|---|
| JP | 2004 11168 | | 1/2004 |
| JP | 2004 138187 | | 5/2004 |
| JP | 2006 64071 | | 3/2006 |
| JP | 2006 226470 | | 8/2006 |
| WO | WO 2006/022043 | A1 | 3/2006 |
| WO | WO 2006/090655 | A1 | 8/2006 |
| WO | WO 2006/107242 | A1 | 10/2006 |
| WO | WO 2006107242 | A1 * | 10/2006 |

OTHER PUBLICATIONS

Extended European Search Report issued Jan. 18, 2012, in Patent Application No. 11191041.0.

* cited by examiner

HYDRAULIC DRIVE DEVICE AND WORKING MACHINE WITH THE SAME

FIELD OF ART

The present invention relates to a hydraulic drive device whereby return oil from a hydraulic actuator driven by a hydraulic pump is regenerated as power of the hydraulic pump.

BACKGROUND ART

Generally, in a working machine such as a hydraulic excavator, there are provided hydraulic actuators such as hydraulic cylinders and a hydraulic motor.

A hydraulic actuator of this type is driven by being supplied with working oil and discharge of the same oil, so during the period after operation for stopping the hydraulic actuator until actual stop of the actuator, return oil higher in pressure than the working oil supplied to the hydraulic actuator is discharged from the actuator due to the own weight of an object to be actuated and an inertia force induced by driving so far performed.

Since such return oil has heretofore been recovered into a tank, the energy of the return oil has been discarded without being utilized for a certain purpose. Particularly, in case such as making a meter-out control or in case of holding a back pressure of the hydraulic actuator, the return oil is recovered into a tank through a throttle valve or the like, so that the energy of the return oil is discarded as heat.

In an effort to solve such a problem, for example in Patent Literature 1 there is disclosed a technique such that return oil from a hydraulic actuator is conducted to a hydraulic motor which is connected to a hydraulic pump to drive the hydraulic motor, thereby utilizing the energy of the return oil as power of the hydraulic pump. More particularly, according to the technique disclosed in Patent Literature 1, in an apparatus provided with a relief valve for protecting a hydraulic circuit connected to a hydraulic actuator and also provided with a switching valve disposed in an oil passage extending between the hydraulic actuator and a hydraulic motor, the flow rate of return oil supplied from the hydraulic actuator to the hydraulic motor is adjusted in accordance with a switching operation of the switching valve, thereby preventing opening of the relief valve and regenerating, as power of the hydraulic pump, the energy of working oil so far consumed for opening the relief valve.

According to this conventional technique, however, the return oil is supplied to the hydraulic motor at a flow rate which has been set for preventing opening of the relief valve, so if the power of the hydraulic pump induced by the supply of the return oil exceeds the originally required power, the hydraulic pump will discharge more working oil than necessary, with a consequent fear of a sudden increase in driven speed of the hydraulic actuator supplied with the working oil.

In a hydraulic excavator, pressure vibration may occur in the actuator circuit due to, for example, a sudden operation of the hydraulic actuator. This pressure vibration occurs also in the hydraulic excavator which adopts such a regeneration method as is disclosed in Patent Literature 1, but no countermeasure to the pressure vibration has so far been adopted by the conventional art and hence the vibration continues for a long time, giving rise to the problem that the operability is deteriorated.

[Patent Literature 1] Japanese Patent Laid-Open Publication No. 2003-120616

DISCLOSURE OF THE INVENTION

The present invention has been accomplished in view of the above-mentioned circumstances and it is a first object of the present invention to provide a hydraulic drive device capable of utilizing return oil effectively while maintaining the driven speed of a hydraulic actuator, as well as a working machine having the hydraulic drive device. It is a second object of the present invention to provide a control unit for a hydraulic working machine adopting a regeneration method, the control unit being able to suppress pressure vibration effectively.

According to the present invention, as means for achieving the above-mentioned first object, there is provided a hydraulic drive device including a hydraulic pump and a hydraulic actuator, the hydraulic actuator being supplied with working oil from the hydraulic pump and being operated by discharging the working oil present in the interior thereof, the hydraulic drive device, comprising a regenerating motor, the regenerating motor being connected to the hydraulic pump so as to be able to drive the hydraulic pump and being driven by being supplied with the working oil from the hydraulic pump, a supply and discharge circuit, the supply and discharge circuit including a supply oil passage for supplying the working oil from the hydraulic pump to the hydraulic actuator, a return oil passage for conducting return oil discharged from the hydraulic actuator to a tank, and a supply and discharge adjusting section capable of adjusting the flow rate of the working oil flowing through the supply oil passage and that of the working oil flowing through the return oil passage simultaneously, an outlet oil passage branching from the return oil passage so as to conduct the return oil to a tank without going through the supply and discharge adjusting section, a regeneration oil passage for conducting the return oil to the regenerating motor without going through the supply and discharge adjusting section, distribution flow rate adjusting means capable of adjusting the flow rate of the return oil flowing through the outlet oil passage and that of the return oil flowing through the regeneration oil passage, and a control section which, during an external force applying period in which the pressure of the return oil exceeds a discharge pressure of the hydraulic pump, specifies a regenerating flow rate capable of being conducted to the regeneration oil passage and a surplus flow rate other than the regenerating flow rate, out of the return oil other than the return oil conducted to the tank through the supply and discharge adjusting section, on the basis of power required of the hydraulic pump, then conducts the return oil of the regenerating flow rate to the regeneration oil passage and controls the distribution flow rate adjusting means so that the return oil of the surplus flow rate is conducted to the outlet oil passage.

According to the present invention, as means for achieving the above-mentioned second object, there is provided a hydraulic drive device with a hydraulic pump driven by an engine, a control valve for supplying oil discharged from the hydraulic pump as a driving source to a hydraulic actuator and operating means for operating the control valve, the hydraulic drive device, including a variable capacity type regenerating motor connected to the engine, the regenerating motor being driven with oil discharged from the hydraulic actuator to regenerate the energy of the oil as an engine assisting force, pressure detecting means for detecting the pressure on an upstream side of the regenerating motor, and control means adapted to receive an input of the pressure detected by the pressure detecting means and increase the capacity of the regenerating motor when the pressure rises (the degree of opening of a meter-out valve may be increased in the case where the hydraulic drive device is provided with the meter-out valve which controls the amount of oil bypassing the regenerating motor and returning to a tank out of the oil discharged from the hydraulic actuator).

BEST MODE FOR CARRYING OUT THE INVENTION

Preferred embodiments of the present invention will be described below with reference to the drawings.

Figure 1:
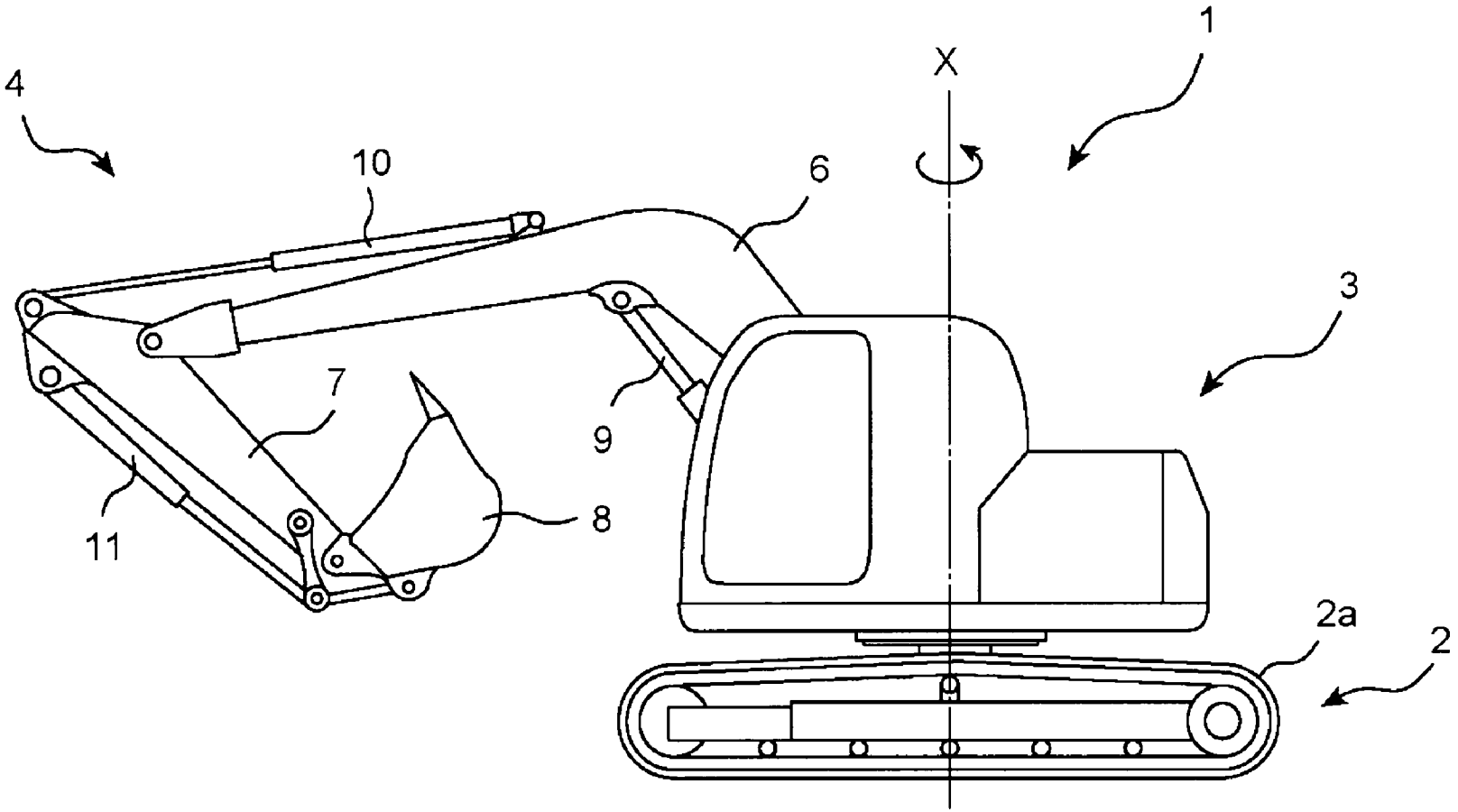
FIG. 1 is a side view of a hydraulic excavator according to an embodiment of the present invention.

FIG. 1 is a side view showing a hydraulic excavator according to a first embodiment of the present invention.

Referring to FIG. 1, a hydraulic excavator 1 as an example of a working machine includes a lower traveling body 2 having crawlers 2*a*, an upper rotating body (rotating body) 3 mounted on the lower traveling body 2 rotatably, a working attachment 4 supported by the upper rotating body 3 so as to be able to rise and lower, and a control unit (see FIG. 2) 5 for controlling the driving of the working attachment 4.

The working attachment 4 includes a boom 6, an arm 7 connected to a front end portion of the boom 6, and a bucket 8 attached to a front end portion of the arm 7 swingably.

The boom 6 is raised and lowered by expanding and contracting motions of a boom cylinder 9. The arm 7 is made to swing by expanding and contracting motions of an arm cylinder 10. The bucket 8 is made to swing with respect to the arm 7 by expanding and contracting motions of a bucket cylinder 11. In this embodiment, the cylinders 9 to 11 correspond to hydraulic actuators.

A rotating motor 12 (see FIG. 7) is installed in the lower traveling body 2. With operation of the rotating motor 12, the upper rotating body 3 is driven for rotation around a vertical axis X with respect to the lower traveling body 2.

Figure 2:
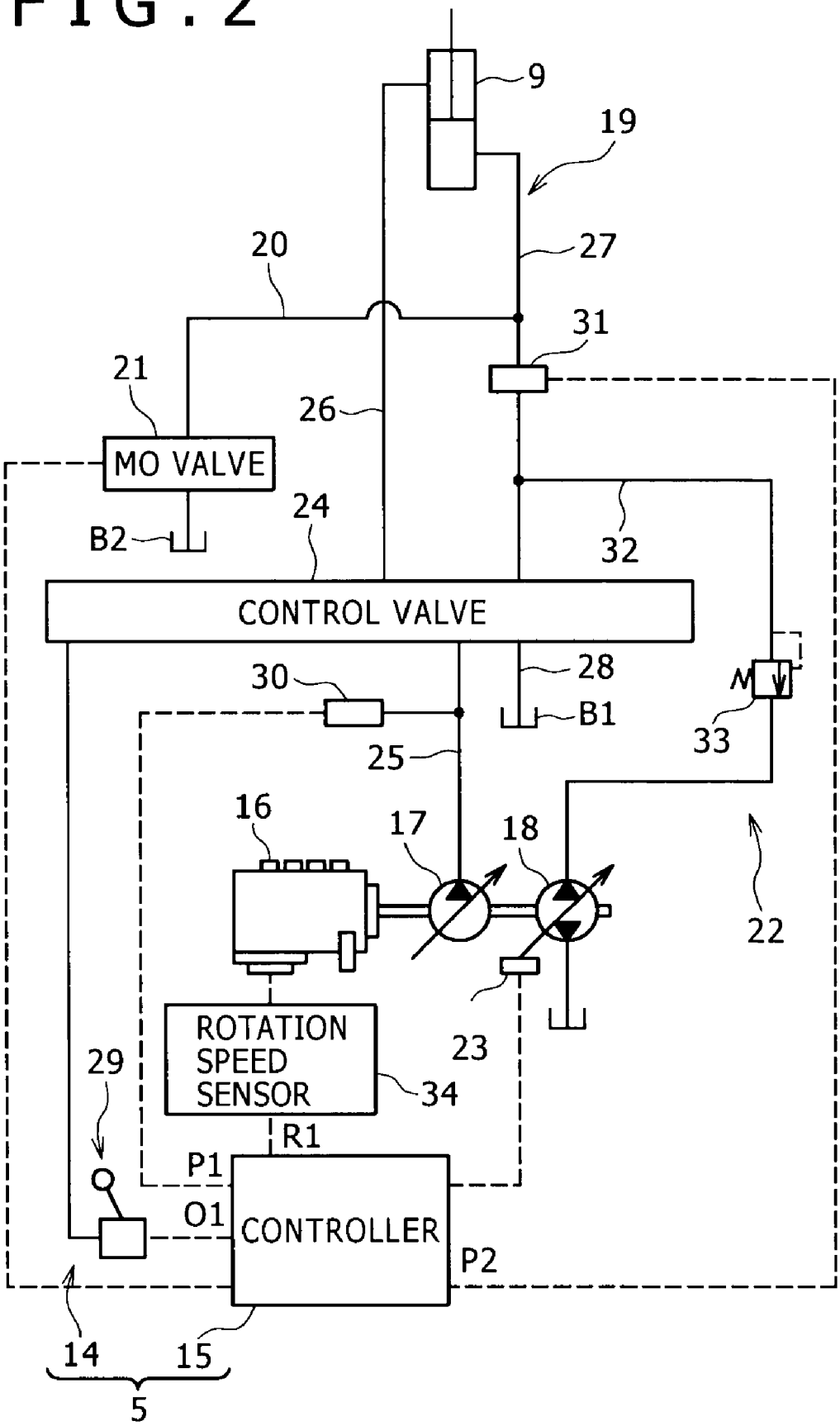
FIG. 2 is a circuit diagram showing an electrical and hydraulic configuration of a control unit provided in the hydraulic excavator of FIG. 1.

FIG. 2 is a circuit diagram showing an electrical and hydraulic configuration of a control unit installed in the hydraulic excavator of FIG. 1.

Referring to FIG. 2, the control unit 5 is provided with a hydraulic circuit 14 which includes the cylinders 9 to 11 and is also provided with a controller (control section) 15 for electrically controlling the flow of working oil in the hydraulic circuit 14. In FIG. 2, out of the cylinders 9 to 11, the boom cylinder 9 is shown as a typical actuator example and the cylinders 10 and 11 are not shown. The following description will also refer to the boom cylinder 9.

The hydraulic circuit 14 includes a hydraulic pump 17 which is driven by an engine 16, a variable capacity type regenerating motor 18 which is connected to the hydraulic pump 17 to drive the hydraulic pump 17, a supply and discharge circuit 19 for supplying working oil discharged from the hydraulic pump 17 to the cylinder 9 and for conducting the working oil discharged from the cylinder 9 to a tank B1, an outlet oil passage 20 branching from the supply and discharge circuit 19 to conduct return oil discharged from the cylinder 9 to a tank B2, a meter-out valve (hereinafter referred to as "MO valve," outlet valve) 21 disposed in the outlet oil passage 20, and a regeneration circuit 22 provided in the supply and discharge circuit 19.

The hydraulic pump 17 is a variable capacity type pump.

The regenerating motor 18 is a variable capacity type hydraulic motor. In the regenerating motor 18, there is provided a regulator (a tilt adjusting section) 23 for adjusting the tilt of the regenerating motor. The regulator 23 is electrically connected to a controller 15 which will be described later.

The supply and discharge circuit 19 supplies the working oil discharged from the hydraulic pump 17 to the cylinder 9 via a control valve (a supply and discharge adjusting section) 24 and conducts the working oil discharged from the cylinder 9 to the tank B1 via the control valve 24.

More specifically, the supply and discharge circuit 19 includes a discharge oil passage 25 which connects the hydraulic pump 17 and the control valve 24, a rod-side oil passage 26 which connects the control valve 24 and a rod-side port of each cylinder 9, a head-side oil passage 27 which connects the control valve 24 and a head-side port of each cylinder 9, a recovery oil passage 28 which connects the control valve 24 and the tank B1, and an operating lever 29 for the supply of pilot pressure to the control valve 24.

A first sensor 30 capable of detecting a working oil discharge pressure P1 from the hydraulic pump 17 is provided in the discharge oil passage 25. The first sensor 30 is electrically connected to the controller 15 which will be described later.

A second sensor 31 capable of detecting the pressure P2 of return oil discharged from each cylinder 9 is provided in the head-side oil passage 27. The second sensor 31 is electrically connected to the controller 15 to be described later.

The operating lever 29 is operated by an operator to adjust a pilot pressure for the control valve 24. An electric signal O1 proportional to the operation of the operating lever 29 is inputted to the controller 15 to be described later.

The outlet oil passage 20 branches from the head-side oil passage 27 and is connected to the MO valve 21. The MO valve 21 has a valve element (not shown) and the flow rate of working oil to be conducted from the outlet oil passage 20 to the tank B2 can be adjusted by adjusting the degree of opening of the valve element. The degree of opening of the valve element is operated in accordance with an electric signal outputted from the controller 15 to be described later.

The regeneration circuit 22 includes a regeneration oil passage 32 branching from the head-side oil passage 27 and connected to the regenerating motor 18 and a holding valve 33 provided in the regeneration oil passage 32. The holding valve 33 opens when the internal pressure of the regeneration oil passage 32 becomes a preset pressure or higher.

On the other hand, the controller 15 receives the pressure P1 detected by the first sensor 30, the pressure P2 detected by the second sensor 31, the signal O1 proportional to the operation of the operating lever 29, and the rotation speed R1 of the engine 16 detected by a rotation speed sensor 34, then on the basis of these pieces of information the controller 15 specifies information for controlling the MO valve 21 and the regulator 23 as follows.

(1) Opening Area A1 of the MO Valve 21 in Case of Regeneration Being not Performed:

On the basis of the input signal O1 provided from the operating lever 29 and a prestored map shown in FIG. 5, the controller 15 specifies an opening area A1 (hereinafter referred to as "non-regeneration opening area A1") of the MO valve 21 in case of regeneration being not performed.

Figure 6:
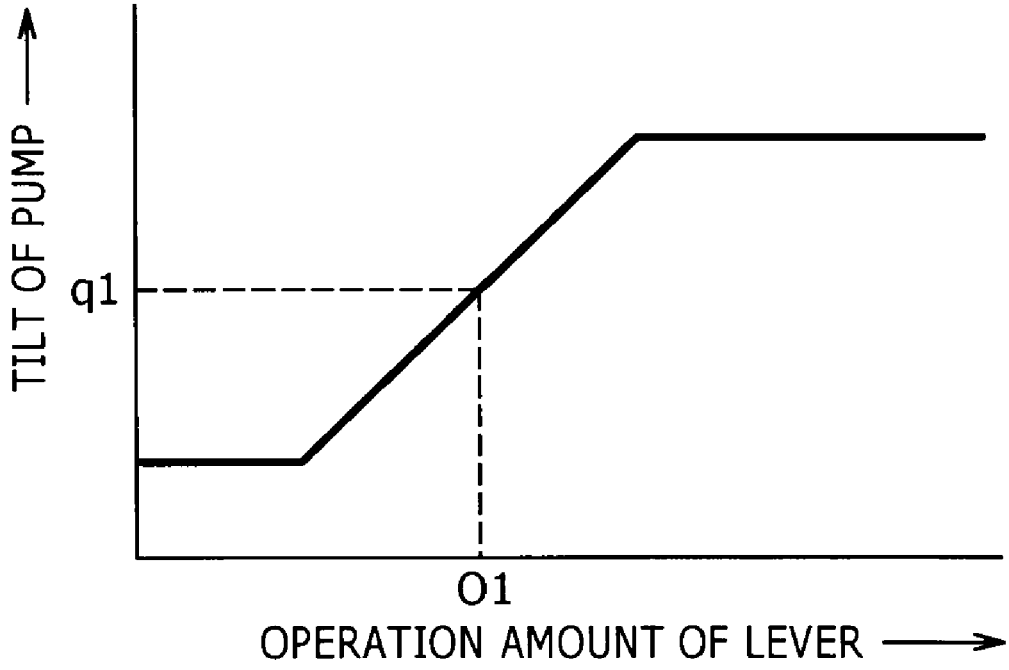
FIG. 6 is a map showing a relation between the operation amount of the operating lever and the tilt of a hydraulic pump.

(2) Target Tilt q1 of the Hydraulic Pump 17:

On the basis of the input signal O1 provided from the operating lever 29 and a prestored map shown in FIG. 6, the controller 15 specifies a target tilt q1 of the hydraulic pump 17.

(3) Target Flow Rate Q1 of the Hydraulic Pump 17:

$$Q1=q1\times R1 \quad [1]$$

The controller 15 calculates the target flow rate Q1 of the hydraulic pump 17 in accordance with the above equation [1] and on the basis of the target tilt q1 and the rotation speed R1 of the engine 16.

(4) Load Power W1 Required of the Engine 16:

$$W1=P1\times Q1+W3 \quad [2]$$

The controller 15 calculates a load power W1 required of the engine 16 in accordance with the above equation [2] and on the basis of the target flow rate Q1, the discharge pressure P1 of the hydraulic pump 17 and an idling power W3 of the engine 16.

(5) Flow Rate Q2 Required of the Regenerating Motor 18 for Creating the Load Power W1:

$$Q2=P2+W1 \quad [3]$$

In accordance with the above equation [3] and on the basis of the load power W1 and the return oil pressure P2 from the cylinders 9~11, the controller 15 calculates a flow rate Q2 (hereinafter referred to as "required flow rate Q2") required to be supplied to the regenerating motor 18 for creating the load power W1.

(6) Flow Rate Q3 of Return Oil in Case of Regeneration to the Regenerating Motor 18 Being not Performed:

$$Q3=Cv\times A1\times\sqrt{(2g\times P2\times\gamma)} \quad [4]$$

In accordance with the above equation [4] and on the basis of a flow rate coefficient Cv, the non-regeneration opening area A1, acceleration of gravity 'g', the return oil pressure P2 and specific gravity γ of working oil, the controller 15 calculates a return oil flow rate Q3 (hereinafter referred to as "regeneratable flow rate Q3") in case of regeneration to the regenerating motor 18 being not performed.

(7) Power W2 Obtainable from Return Oil in Case of Regeneration Being not Performed:

$$W2=P2\times Q3 \quad [5]$$

In accordance with the above equation [5] and on the basis of the return oil pressure P2 and the regeneratable flow rate Q3, the controller 15 calculates power W2 (hereinafter referred to as "regeneratable power W2") capable of being obtained from return oil in case of regeneration being not performed.

(8) Maximum Flow Rate Qmax Capable of Flowing in the Regenerating Motor 18:

$$Q\max=q\max\times R1 \quad [6]$$

In accordance with the above equation [6] and on the basis of a maximum tilt qmax of the regenerating motor 18 and the rotation speed R1 of the engine 16, the controller 15 calculates a maximum flow rate Qmax (hereinafter referred to as "maximum flow rate Qmax") capable of flowing in the regenerating motor 18.

Figure 3:
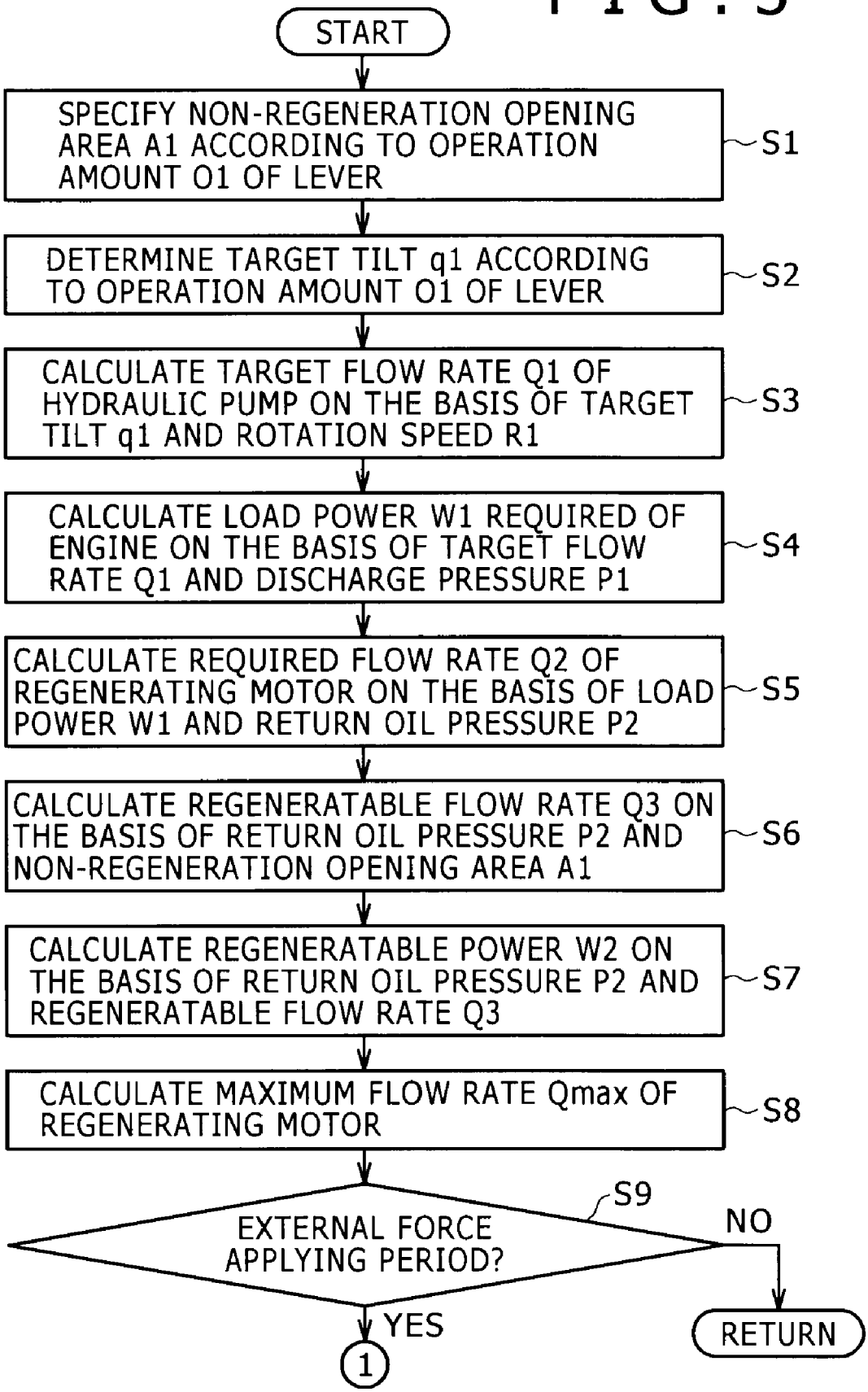
FIG. 3 is a flow chart showing a former half of a processing carried out by a controller used in the control unit.
Figure 4:
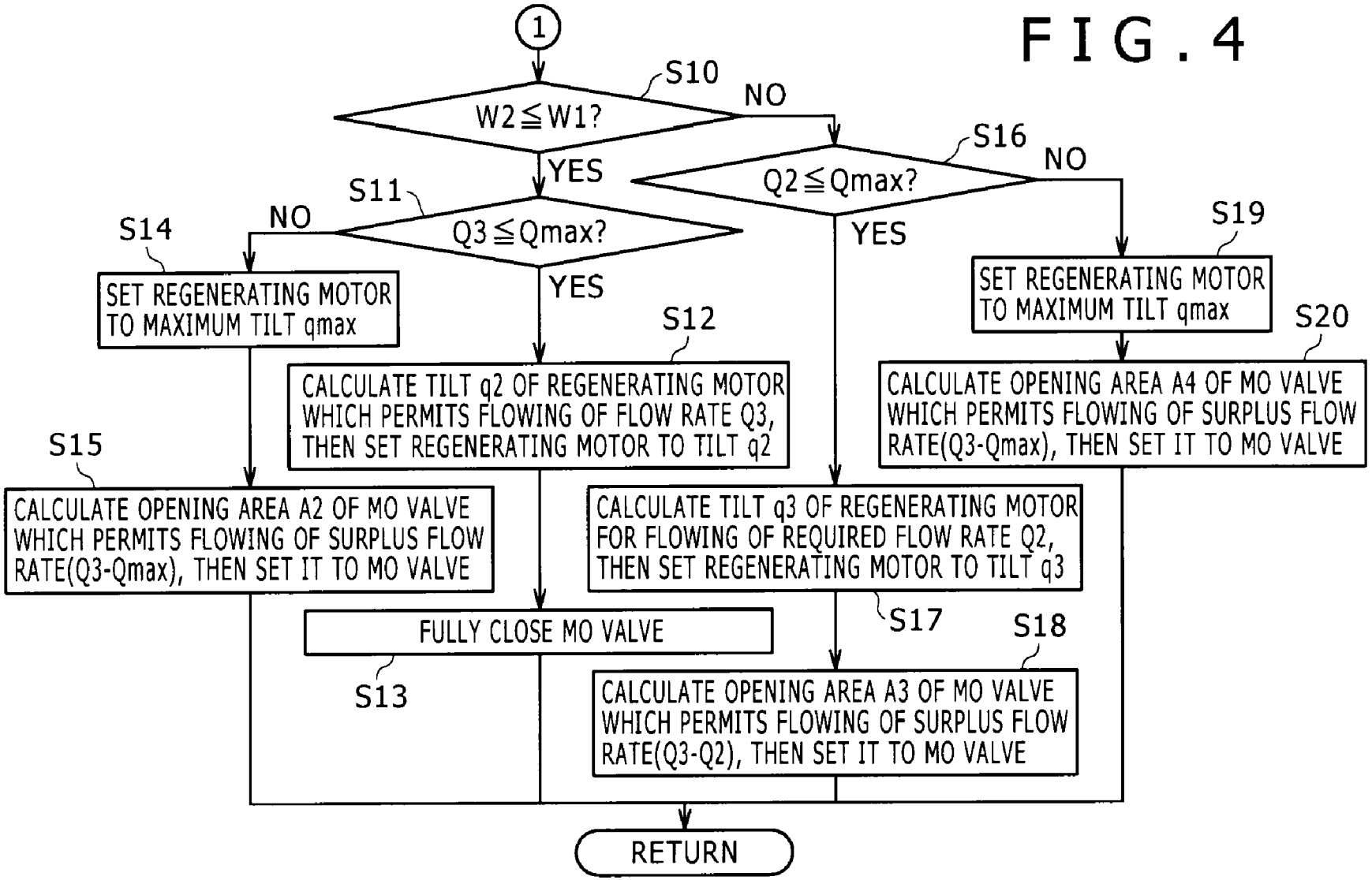
FIG. 4 is a flow chart showing a latter half of the processing carried out by the controller used in the control unit.

The controller 15 further calculates other numerical values, but this point will be explained together with concrete processing contents shown in FIGS. 3 and 4. FIG. 3 is a flow chart showing a former half of the processing carried out by the controller 15 and FIG. 4 is a flow chart showing a latter half of the processing carried by the controller 15.

Figure 5:
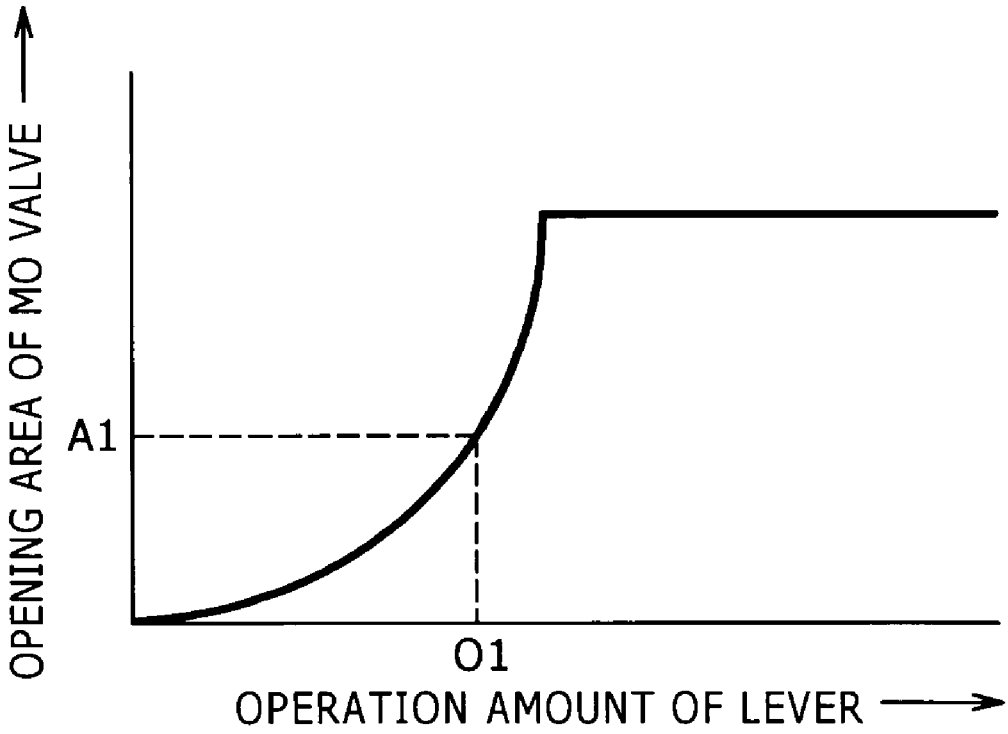
FIG. 5 is a map showing a relation between the operation amount of an operating lever and an opening area of an MO valve.

Referring to FIG. 3, the controller 15 first specifies the non-regeneration opening area A1 on the basis of the input signal O1 provided from the operating lever 29 and the map shown in FIG. 5 (step S1). That is, the controller 15 specifies an opening area for meter-out control.

More specifically, in the map of FIG. 5, on the basis of a driven speed of the rotating motor 12 which is to be set when the hydraulic pump 17 is operated to a specific tilt, there is prescribed an opening area of the MO valve 21 for attaining the driven speed.

Then, the controller 15 specifies the target tilt q1 on the basis of the input signal O1 and the map of FIG. 6 (step S2) and calculates the target flow rate Q1 of the hydraulic pump 17 on the basis of the target tilt q1 and the rotation speed R1 of the engine 16 (step S3).

Next, the controller 15 calculates the load power W1 required of the engine 16 on the basis of the thus-calculated target flow rate Q1 and the discharge pressure P1 of the hydraulic pump 17 (step S4), then calculates the required flow rate Q2 of the regenerating motor 18 on the basis of the load power W1 and the return oil pressure P2 (step S5).

Further, the controller 15 calculates the regeneratable flow rate Q3 on the basis of the return oil pressure P2 and the non-regeneration opening area A1 (step S6), then calculates the regeneratable power W2 on the basis of the regeneratable flow rate Q3 and the return oil pressure P2 (step S7), and calculates the maximum flow rate Qmax of the regenerating motor 18 on the basis of the maximum tilt qmax of the regenerating motor 18 and the rotation speed R1 of the engine 16 (step S8).

Next, the controller 15 determines whether an external force applying period is now under way or not, on the basis of the operation amount O1 of the operating lever 29 (step S9). In this embodiment, as shown in FIG. 1, the own weight of the boom 6 acts in a direction to shorten the rod of the cylinder 9, so in a lowering period of the boom 6, the pressure of return oil from the cylinder 9 becomes higher than that of the working oil supplied to the cylinder 9. Therefore, in step S9, the controller 15 determines whether the operation for lowering the boom 6 is being done by the operating lever 29 and thereby determines whether the external force applying period is now under way or not.

If the controller 15 determines in step S9 that the external force applying period is not under way (NO in step S9), it carries out the step S1 repeatedly, while if the controller 15 determines that the external force applying period is now under way (YES in step S9), it shifts the execution to the processing shown in FIG. 4.

The controller first determines whether the load power W1 required of the engine 16 is not lower than the regeneratable power W2 (step S10). That is, in step S10, a comparison is made as to which is higher between the regeneratable power W2 which can be obtained from return oil when regeneration to the regenerating motor 18 is not performed and the load power W1 required of the engine 16, then on the basis of this comparison the controller 15 determines whether the whole of the regeneratable power W2 can be utilized or not as part of the load power W1.

If it is determined in step S10 that the load power W1 is not lower than the regeneratable power W2 (YES in step S10), the controller 15 determines whether the regeneratable flow rate Q3 of return oil in case of regeneration to the regenerating motor 18 being not performed is not larger than the maximum flow rate Qmax capable of flowing in the regenerating motor 18 (step S11). That is, in step S11, it is determined whether the regenerating motor 18 can accept the whole of the regeneratable flow rate Q3 which is the maximum flow rate of return oil.

If it is determined in step S11 that it is possible to accept the whole of the regeneratable flow rate Q3 (YES in step S11), the controller 15 calculates a tilt q2 of the regenerating motor 18 for flowing of the regeneratable flow rate Q3 and adjusts the regenerating motor 18 to the tilt q2 (step S12).

$$q2=Q3\div R1 \quad [7]$$

That is, in step S12, in accordance with the above equation [7] and on the basis of the regeneratable flow rate Q3 and the rotation speed R1 of the engine 16, the controller 15 calculates the tilt q2 of the regenerating motor 18 which permits flowing of the regeneratable flow rate Q3, then adjusts the regenerating motor 18 to the tilt q2.

In the next step S13, the MO valve 21 is fully closed, thereby the whole of the regeneratable flow rate Q3 flows to the regenerating motor 18.

On the other hand, if the controller 15 determines in step S11 that the regeneratable flow rate Q3 is larger than the maximum flow rate Qmax of the regenerating motor 18 (NO in step S11), it assumes that the regenerating motor 18 cannot accept the whole of the maximum flow rate Qmax (there exists a surplus flow rate), then adjusts the regenerating motor 18 to the maximum tilt qmax (step S14) and further adjusts an opening area A2 of the MO valve 21 so that the surplus flow rate can be conducted to the tank B2 through the MO valve 21 (step S15).

$$A2=(Q3-Q\max)\div\{Cv\times\sqrt{(2g\times P2\times\gamma)}\} \quad [8]$$

That is, in step S15, the controller 15 calculates the opening area A2 of the MO valve 21 in accordance with the above equation [8] and on the basis of a surplus flow rate (Q3−Qmax) incapable of flowing to the regenerating motor 18 and the return oil pressure P2.

In the processings of steps S14 and S15, with respect to the regeneratable flow rate Q3, the flow rate Qmax (regenerating flow rate) is regenerated to the regenerating motor 18, while the surplus flow rate (Q3−Qmax) can be conducted to the tank B2 through the MO valve 21.

On the other hand, if it is determined in step S10 that the regeneratable power W2 obtainable from return oil exceeds the load power W1 required of the engine 16 (NO in step S10), the controller 15 determines whether the required flow rate Q2 to be supplied to the regenerating motor 18 for creating the load power W1 is not larger than the maximum flow rate Qmax of the regenerating motor 18 (step S16).

That is, in step S16, it is determined whether the whole of the required flow rate Q2 for making up the load power W1 can be allowed to flow to the regenerating motor 18, and if it is determined that the required flow rate Q2 is not larger than the maximum flow rate Qmax (YES in step S16), the controller 15 calculates a tilt q3 of the regenerating motor 18 for flowing of the required flow rate Q2 and adjusts the motor 18 to the tilt q3 (step S17).

$$q3=Q2\div R1 \quad [9]$$

That is, in step S17, the controller 15 calculates the tilt q3 in accordance with the above equation [9] and on the basis of the required flow rate Q2 and the rotation speed R1 of the engine 16.

Next, the controller 15 calculates an opening area A3 of the MO valve 21 for flowing of a surplus flow rate (Q3−Q2) with respect to the regeneratable flow rate Q3 and adjusts the MO valve 21 to the opening area A3 (step S18).

$$A3=(Q3-Q2)\div\{Cv\times\sqrt{(2g\times P2\times\gamma)}\} \quad [10]$$

That is, in step S18, in accordance with the above equation [10] the controller 15 calculates the opening area A3 of the MO valve 21 which permits flowing of the surplus flow rate (Q3−Q2) at the return oil pressure P2, then adjusts the MO valve 21 to the opening area A3.

If it is determined in step S16 that the required flow rate Q2 exceeds the maximum flow rate Qmax of the regenerating motor 18 (NO in step S16), the controller 15 adjusts the regenerating motor 18 to the maximum tilt qmax (step S19), then calculates an opening area A4 of the MO valve 21 which permits flowing of a surplus flow rate (Q3−Qmax) and adjusts the MO valve 21 to the opening area A4 (step S20).

$$A4=(Q3-Q\max)\div\{Cv\times\sqrt{(2g\times P2\times\gamma)}\} \quad [11]$$

That is, in step S20, in accordance with the above equation [11] the controller 15 calculates the opening area A4 of the MO valve 21 which permits flowing of the surplus flow rate (Q3−Qmax) at the return oil pressure P2, then adjusts the MO valve 21 to the opening area A4.

In this embodiment, as described above, the regenerating flow rate capable of being conducted to the regeneration oil passage 32 and the surplus flow rate other than the regenerating flow rate are specified during the external force applying period in which the return oil pressure P2 exceeds the discharge pressure P1 of the hydraulic pump 17, and only the return oil of the regenerating flow rate is supplied to the regenerating motor, so that the return oil of a flow rate larger than the flow rate which creates the power required of the hydraulic pump 17 is prevented from being supplied to the regenerating motor 18.

Thus, according to this embodiment, since the discharge flow rate of the hydraulic pump 17 is prevented from increasing to a greater extent than necessary, it is possible to utilize the return oil effectively while maintaining the driven speed of the cylinders 9~11 and that of the rotating motor 12.

As in the above embodiment, if there is adopted a construction such that a flow rate of not larger than the regeneratable flow rate Q3 is set to the regenerating flow rate when the regeneratable power W2 is not higher than the load power W1 (YES in step S10), it is possible to prevent the discharge flow rate of the hydraulic pump 17 from exceeding the target flow rate Q1.

As in the above embodiment, if there is adopted a construction such that the regulator 23 is operated and the MO valve 21 is fully closed (steps S12 and S13) so as to permit acceptance of the regeneratable flow rate Q3 when the regeneratable flow rate Q3 is not larger than the maximum flow rate Qmax of the regenerating motor 18 (YES in step S11), it is possible to utilize the whole of return oil effectively.

As in the above embodiment, if there is adopted a construction such that when the regeneratable flow rate Q3 exceeds the maximum flow rate Qmax (NO in step S11), the maximum flow rate Qmax is set to the regenerating flow rate, and a flow rate corresponding to the regeneratable flow rate Q3 minus maximum flow rate Qmax is set to the surplus flow rate (steps S14 and S15), it is possible to prevent the surplus return oil from being supplied to the regenerating motor 18 and protect the regenerating motor 18.

As in the above embodiment, if there is adopted a construction such that a flow rate of not larger than the required flow rate Q2 of the regenerating motor 18 is set to the regenerating flow rate when the regeneratable power W2 exceeds the load power W1 (NO in step S10), it is possible to prevent a power of not lower than the load power W1 from being created in the regenerating motor 18.

As in the above embodiment, if there is adopted a construction such that when the required flow rate Q2 exceeds the maximum flow rate Qmax (NO in step S16), the maximum flow rate Qmax adjusts the regenerating motor 18 to the maximum tilt qmax and the opening area of the MO valve 21 is adjusted so as to permit flowing of a flow rate corresponding to the regeneratable flow rate Q3 minus the maximum flow rate Qmax (steps S19 and 20), return oil of a flow rate exceeding the maximum flow rate Qmax is prevented from being supplied to the regenerating motor 18 and it is thereby possible to make protection of the regenerating motor 18.

As in the above embodiment, if there is adopted a construction such that when the required flow rate Q2 is not larger than the maximum flow rate Qmax (YES in step S16), the required flow rate Q2 is set to the regenerating flow rate and a flow rate corresponding to the regeneratable flow rate Q3 minus the required flow rate Q2 is set to the surplus flow rate (steps S17 and S18), return oil of a surplus flow rate can be conducted from the MO valve 21 to the tank B2 while ensuring the supply of return oil at a flow rate required of the regenerating motor 18.

Although in the above embodiment the boom cylinder 9 is described as an example of a hydraulic actuator, it is also possible to adopt a construction wherein return oil from the rotating motor 12 which is for rotating the upper rotating body 3 is supplied to the regenerating motor. This construction will be described below as a second embodiment of the present invention with reference to FIG. 7.

Figure 7:
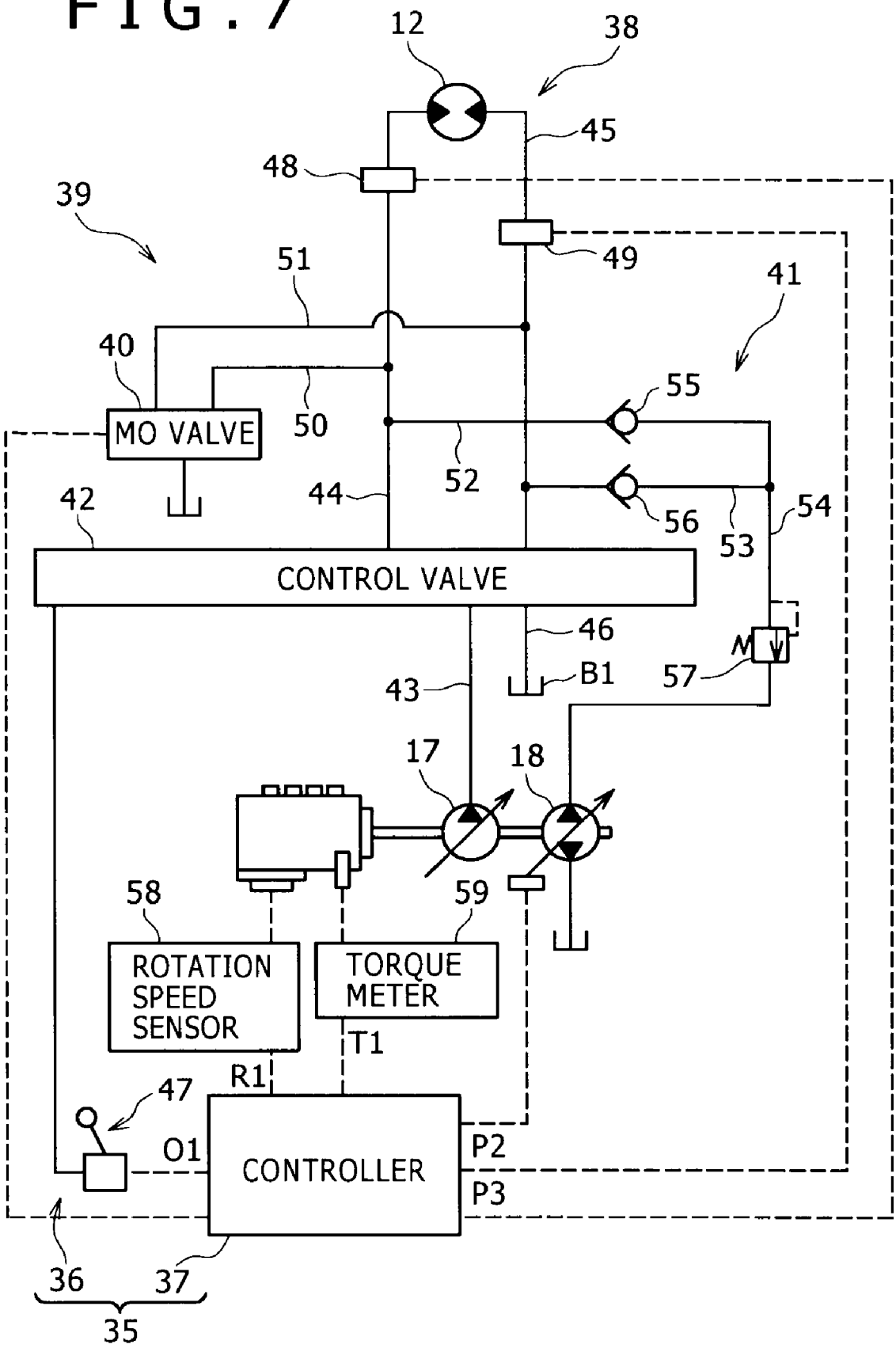
FIG. 7 is a circuit diagram showing an electrical and hydraulic configuration of a control unit according to a second embodiment of the present invention.

FIG. 7 is a circuit diagram showing an electrical and hydraulic configuration of a control unit according to a second embodiment of the present invention.

The control unit according to this embodiment, indicated at 35, includes a hydraulic circuit 36, which includes the rotating motor 12, and a controller (control section) 37 for electrically controlling the flow of working oil in the hydraulic circuit 36.

The hydraulic circuit 36 includes the hydraulic pump 17, the regenerating motor 18, a supply and discharge circuit 38 for supplying working oil discharged from the hydraulic pump 17 to the rotating motor 12 and for conducting working oil discharged from the rotating motor 12 to the tank B1, an outlet oil passage 39 branching from the supply and discharge circuit 38 to conduct return oil discharged from the rotating motor 12 to the tank B2, an MO valve (outlet valve) 40 disposed in the outlet oil passage 39, and a regeneration circuit 41 formed in the supply and discharge circuit 38.

The supply and discharge circuit 38 supplies working oil discharged from the hydraulic pump 17 to the rotating motor 12 through a control valve (a supply and discharge adjusting section) 42 and conducts working oil discharged from the rotating motor 12 to the tank B1 through the control valve 42.

More specifically, the supply and discharge circuit 38 includes a discharge oil passage 43 which connects the hydraulic pump 17 and the control valve 42, a first oil passage 44 and a second oil passage 45 which connect the control valve 42 and both ports of the rotating motor 12, a recovery oil passage 46 which connects the control valve 42 and the tank B1, and an operating lever 47 for supplying a pilot pressure to the control valve 42.

A first pressure sensor 48 capable of detecting the pressure P3 of working oil present within the first oil passage 44 is disposed in the first oil passage 44. The first pressure sensor 48 is electrically connected to the controller 37 which will be described later.

A second pressure sensor 49 capable of detecting the pressure P2 of working oil present within the second oil passage 45 is disposed in the second oil passage 45. The second pressure sensor 49 is electrically connected to the controller 37 to be described later.

The operating lever 47 is operated by an operator to adjust a pilot pressure for the control valve 42. An electric signal O1 proportional to the operation amount of the operating lever 47 is inputted to the controller 37 to be described later.

The outlet oil passage 39 includes a first outlet oil passage 50 and a second outlet oil passage 51 branching from the first oil passage 44 and the second oil passage 45 respectively, the outlet oil passages 50 and 51 being connected to the MO valve 40. In accordance with a command provided from the controller 37, the MO valve 40 causes a change in flow rate of the working oil flowing toward the tank B2 through the outlet oil passages 50 and 51.

The regeneration circuit 41 includes a first regeneration oil passage 52 and a second regeneration oil passage 53 branching from the first oil passage 44 and the second oil passage 45 respectively and a confluent oil passage 54 connected to the regenerating motor 18 to join both regeneration oil passages 52, 53. In the regeneration oil passages 52 and 53, there are disposed check valves 55 and 56 respectively which permit flowing of the working oil advancing toward the confluent oil passage 54 but block flowing to the opposite side. On the other hand, in the confluent oil passage 54 is disposed a holding valve 57 which opens when the working oil pressure in each of the regeneration oil passages 52 and 53 exceeds a predetermined value.

The controller 37 receives pressure P3 detected by the first pressure sensor 48, pressure P2 detected by the second pressure sensor 49, a signal O1 proportional to operation of the operating lever 47, the rotation speed R1 of the engine 16 detected by a rotation speed sensor 58 and torque T1 of the engine 16 detected by a torque meter 59, then on the basis of these pieces of information specifies information for controlling the MO valve 40 and the regulator 23 as follows. In the following description it is assumed that the second oil passage 45 lies on the discharge side of the rotating motor 12, and explanations of the same portions as in the previous embodiment will be omitted.

In accordance with the following equation and on the basis of the torque T1 of the engine 16 and the rotation speed R1 of the engine 16, the controller 37 calculates the load power W1 required of the engine 16:

$$W1 = T1 \times R1 \quad [12]$$

In this second embodiment the load power W1 can be calculated on the basis of the torque T1 and the rotation speed R1 and therefore, unlike the previous embodiment, the first sensor 30 (see FIG. 2) for detecting the discharge pressure of the hydraulic pump 17 is not needed.

Figure 8:
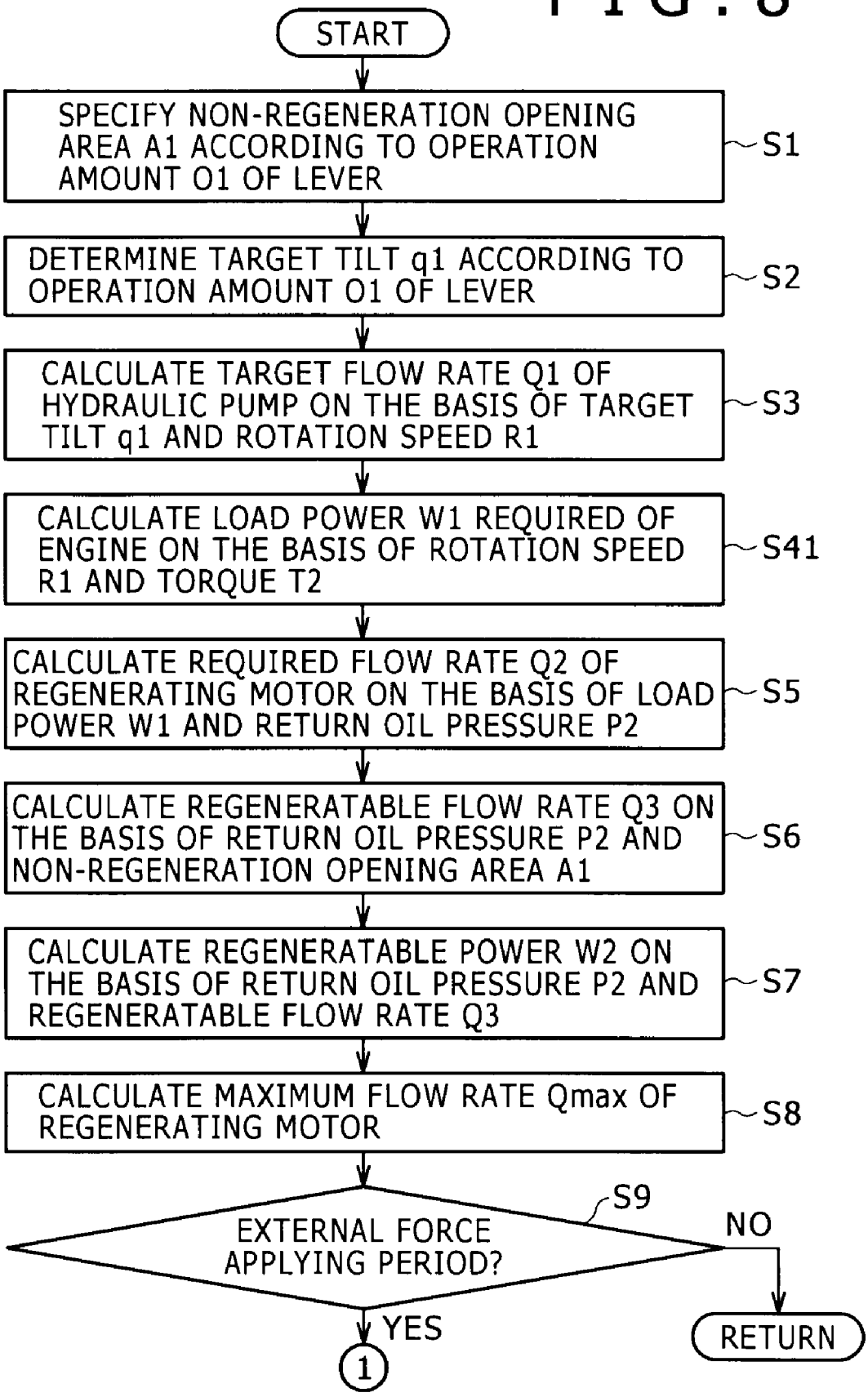
FIG. 8 is a flow chart showing a former half of a processing performed by a controller used in the second embodiment.

The processing carried out by the controller 37 will be described below with reference to FIG. 8. FIG. 8 is a flow chart showing the processing carried out by the controller 37.

Referring to FIG. 8, the controller 37 first carries out steps S1~S3 as in the previous embodiment. More specifically, the controller 37 specifies a non-regeneration opening area A1 and a target tilt q1 both proportional to the input signal O1 provided from the operating lever 47 (steps S1 and S2) and then calculates a target flow rate Q1 of the hydraulic pump 17 on the basis of the target tilt q1 and the rotation speed R1 of the engine (step S3).

Next, on the basis of the rotation speed R1 and torque T1 of the engine 16 and in accordance with the foregoing equation [12], the controller 37 calculates a load power W1 required of the engine 16 (step S41).

On the basis of the load power W1 thus calculated and the pressure of return oil from the rotating motor 12, the controller 37 calculates a required flow rate Q2 of the regenerating motor 18 as in the foregoing step S5.

Subsequently, as in the previous embodiment, the controller 37 carries out steps S6~S9 and then carries out the processing shown in FIG. 4. In step S9 in this embodiment it is specified which of the first oil passage 44 and the second oil passage 45 corresponds to the discharge side of the rotating motor 12, on the basis of the input signal O1 provided from the operating lever 47, then it is determined whether the internal pressure (P2) of the oil passage (the second oil passage 45 in the example of FIG. 8) specified to be the discharge side is larger than the internal pressure (P3) of the supply-side oil passage (the first oil passage 44), and thereby it is determined whether an external force applying period is now under way or not.

A hydraulic drive device according to a third embodiment of the present invention will now be described with reference to FIGS. 9 to 12. The hydraulic drive device of this third embodiment aims at suppressing pressure vibration effectively in a hydraulic working machine which adopts a regeneration method. An example will be described below in which this hydraulic drive device is applied to a boom cylinder circuit in a hydraulic excavator.

Figure 9:
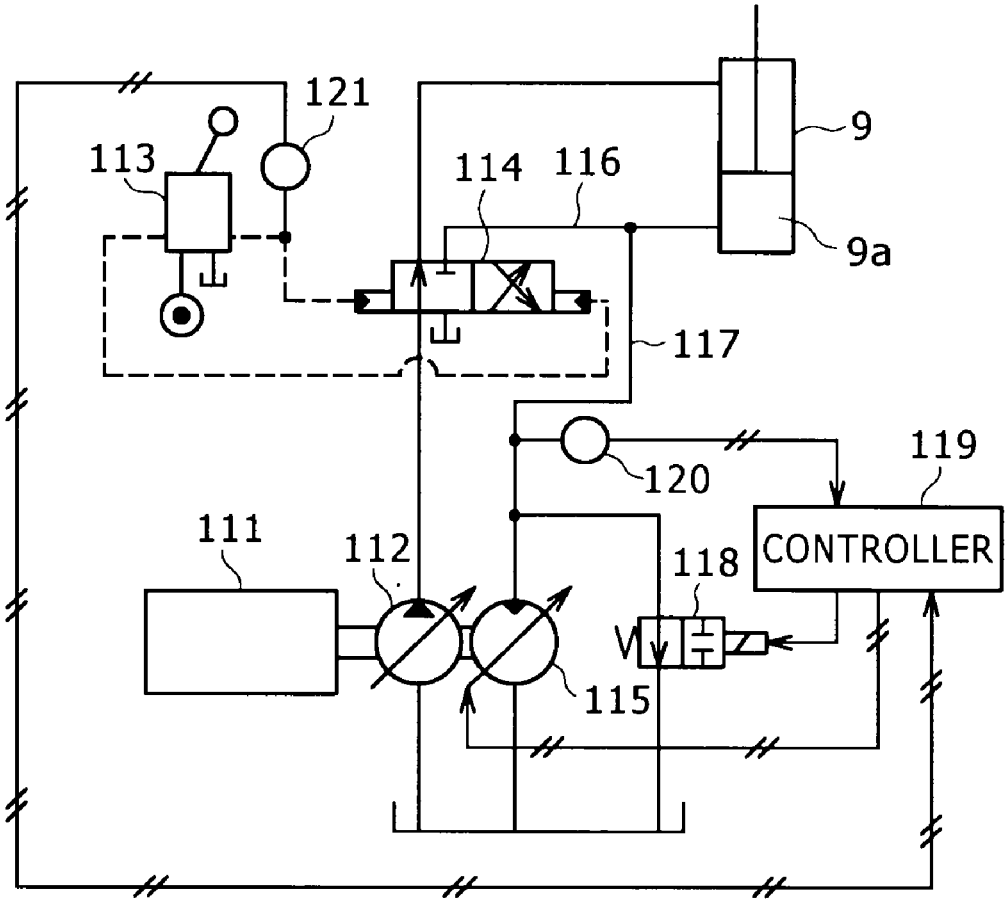
FIG. 9 is a configuration diagram of a boom cylinder circuit according to a third embodiment of the present invention.

The hydraulic drive device shown in FIG. 9 includes a hydraulic pump 112 which is driven by an engine 111, a control valve 114 for conducting oil discharged from the hydraulic pump 112 to the boom cylinder 9, and a remote control valve (operating means) 113 for operating the control valve 114.

A variable capacity type regenerating motor 115 is connected to the engine 111. Oil discharged from a boom raising-side oil chamber 9*a* of the boom cylinder 9 upon operation of a boom lowering side (contraction side) of the boom cylinder 9 is introduced into the regenerating motor 115 via a regeneration line 117 branching from a boom raising-side line 116. The oil thus introduced causes the regenerating motor 115 to rotate. That is, the regenerating motor 115 is driven with oil discharged from the boom cylinder 9, thereby the energy of the oil is regenerated as an engine assisting force.

A solenoid proportional bypass valve 118 is connected in parallel to the regenerating motor 115. The bypass valve 118 controls the amount of oil bypassing the regenerating motor 115 and returning to a tank T out of the oil discharged from the boom cylinder 9. The capacity of the regenerating motor 115 and the degree of opening of the bypass valve 118 are controlled by a controller 119.

Various sensors are provided in this hydraulic drive device. Among these sensors are included a pressure sensor 120 as pressure detecting means for detecting the pressure of the regeneration line 117 and a pilot pressure sensor 121 for detecting a pilot pressure (the operation amount of the remote control valve) which is fed from the remote control valve 113 to the control valve 114 at the time of a boom lowering operation. The pressures detected by both sensors 120 and 121 are inputted to the controller 119, which in turn controls the capacity of the regenerating motor 115 as follows on the basis of the pressures.

Figure 10:
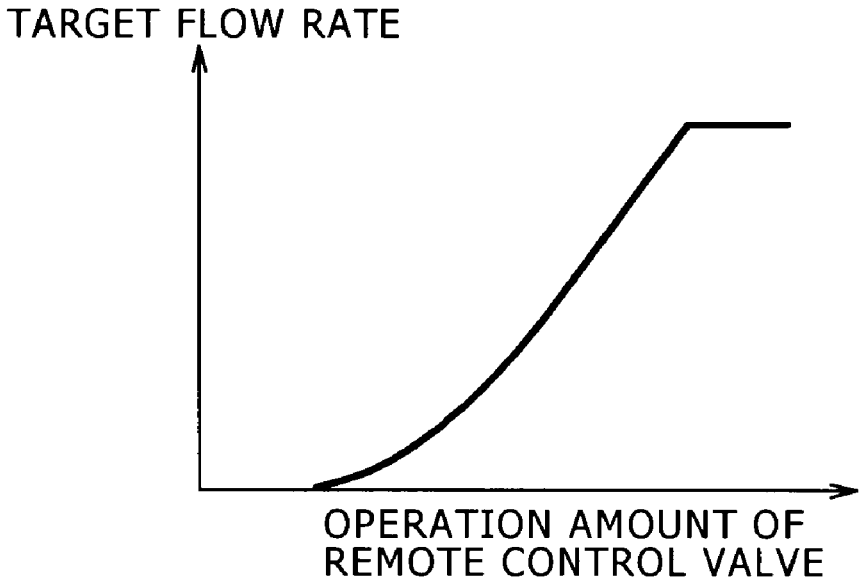
FIG. 10 is a diagram showing a relation between the operation amount of a remote control valve and a target flow rate in the third embodiment.

FIG. 10 shows a relation between the operation amount of the remote control valve 113 and a target flow rate determined by operation of the control valve 114 which is proportional to the operation amount of the remote control valve.

At the time of a boom lowering-side operation of the remote control valve 113, the controller 119, on the basis of the aforesaid relation, calculates a target flow rate of oil discharged from the boom raising-side oil chamber 9*a* of the boom cylinder 9 and determines a target capacity of the regenerating motor 115 from the thus-calculated target flow rate in accordance with the following equation:

$$qref=Qref/\omega$$

where ω stands for the rotation speed of engine detected by, for example, an engine rotation speed sensor which is not shown, Qref stands for a target flow rate of discharged oil, and qref stands for a target capacity of the regenerating motor 115.

A constant pressure (holding pressure) acts on the boom raising-side oil chamber 9*a* of the boom cylinder 9, for example, under the own weight of the attachment 4 shown in FIG. 1, and upon occurrence of pressure vibration due to, for example, a sudden operation of the remote control valve 113, a pressure corresponding to the holding pressure plus the pressure of the vibration is exerted on an upstream side (the regeneration line 117) of the regenerating motor 115.

Figure 11:
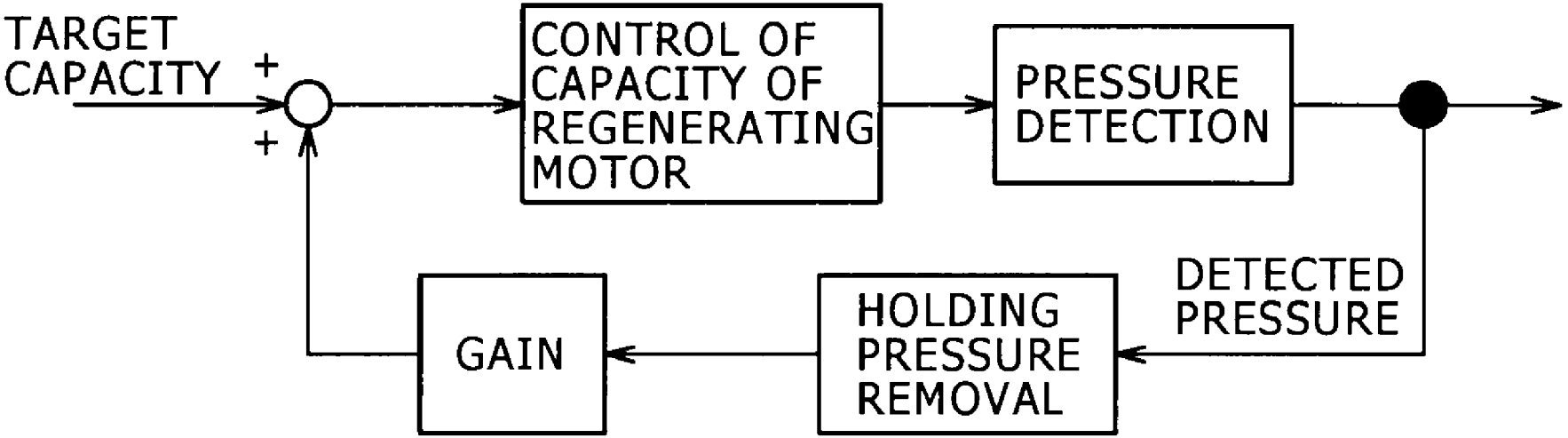
FIG. 11 is a block diagram for explaining the operation of the third embodiment.

In this state, as shown in FIG. 11, the controller 119 removes the holding pressure as a constant component with use of a bypass filter or the like from the pressure (detected pressure) acting on the regeneration line 117 and extracts only the vibration component, then multiplies it by a gain and adds the resulting value to the target capacity to obtain a final target capacity value, then controls the motor capacity on the basis of the final value. More particularly, against a pressure rise, the controller 119 increases the motor capacity to increase the amount of oil discharged, while against a pressure drop, the controller 119 decreases the motor capacity to decrease the amount of oil discharged. Such a motor capacity feedback control makes it possible to quickly damp the pressure vibration upon occurrence.

Figure 12:
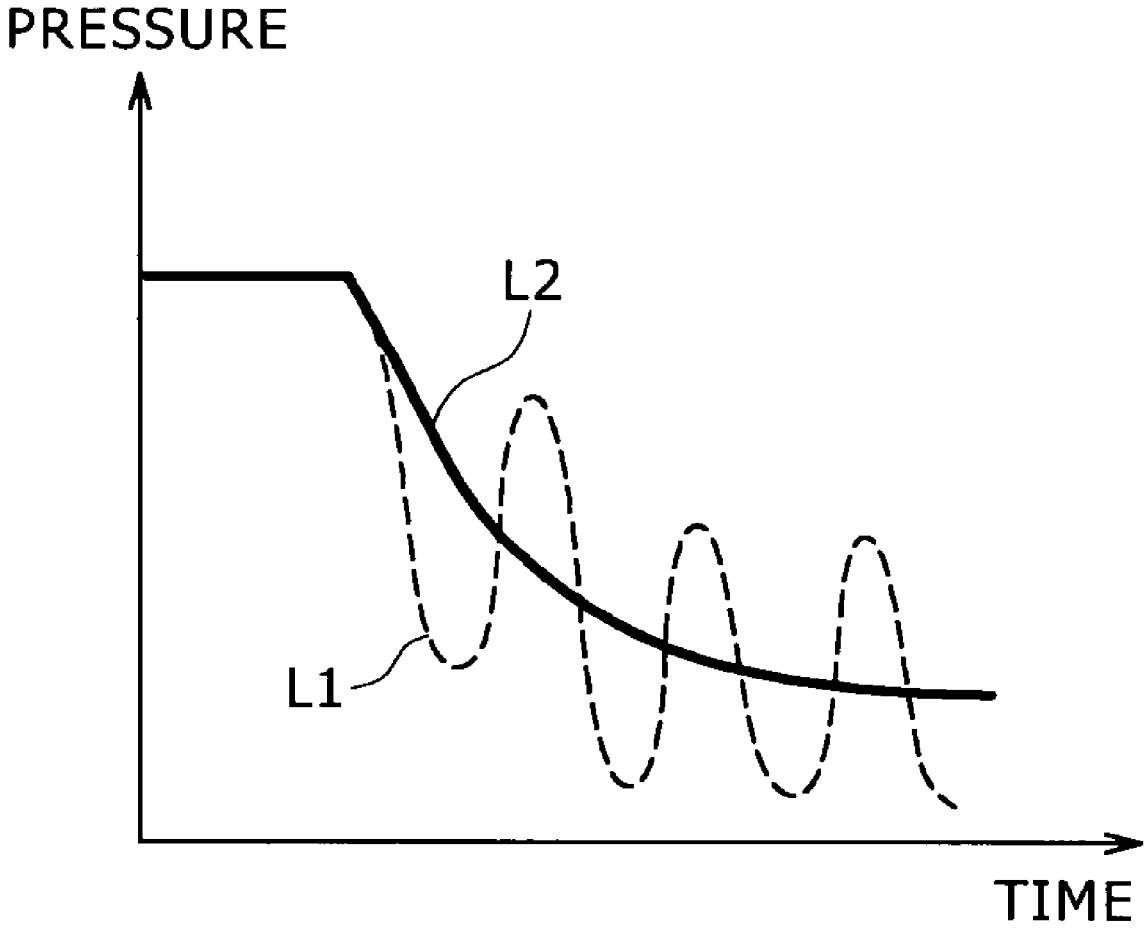
FIG. 12 is a diagram showing a vibration damping effect obtained in the third embodiment.

FIG. 12 shows this vibration damping effect. In the same figure, a broken line L1 represents a pressure condition in an uncontrolled state, while a solid line L2 represents a pressure condition under the above feedback control. As shown in the same figure, in an uncontrolled state, the pressure retains its vibratory waveform and does not become extinct over long time, while the above feedback control brings about a smooth change of the pressure, thereby preventing vibration of the boom cylinder 9 and improving the operability.

Further, the use of the regenerating motor 115 in vibration damping control eliminates the need of adding hydraulic device and circuit for vibration damping and permits the attainment of a reliable vibration damping effect with use of a simple circuit configuration of a low cost.

Additionally, performing a feedback control based on only the vibration component out of the detected pressure as described above makes it possible to perform a more accurate vibration damping control according to a vibration condition and enhances the vibration damping effect.

Further, the present invention can adopt the following modifications in connection with the third embodiment.

(1) The means for controlling the amount of oil discharged from the boom cylinder 9 is not limited to controlling the capacity of the regenerating motor 115 but may be controlling the degree of opening of the bypass valve 118 as a meter-out valve. If this control is performed in a direction to increase the amount of discharged oil against a pressure rise, it is possible to obtain basically the same function and effect as in the third embodiment.

(2) The object of application of the present invention is not limited to the boom cylinder circuit that regenerates the position energy of the boom cylinder 9. The present invention is applicable also to a rotating motor circuit which regenerates inertia energy in rotation, provided a regenerating action is performed on both-side lines of the rotating motor and the vibration damping control is performed.

Thus, the present invention provides a hydraulic drive device including a hydraulic pump and a hydraulic actuator, the hydraulic actuator being supplied with working oil from the hydraulic pump and being operated by discharging the working oil present in the interior thereof. The hydraulic drive device further comprises a regenerating motor, the regenerating motor being connected to the hydraulic pump so as to be able to drive the hydraulic pump and being driven by being supplied with the working oil from the hydraulic pump, a supply and discharge circuit, the supply and discharge circuit including a supply oil passage for supplying the working oil from the hydraulic pump to the hydraulic actuator, a return oil passage for conducting return oil discharged from the hydraulic actuator to a tank, and a supply and discharge adjusting section capable of adjusting the flow rate of the working oil flowing through the supply oil passage and that of the working oil flowing through the return oil passage simultaneously, an outlet oil passage branching from the return oil passage so as to conduct the return oil to a tank without going through the supply and discharge adjusting section, a regeneration oil passage for conducting the return oil to the regenerating motor without going through the supply and discharge adjusting section, distribution flow rate adjusting means capable of adjusting the flow rate of the return oil flowing through the outlet oil passage and that of the return oil flowing through the regeneration oil passage, and a control section which, during an external force applying period in which the pressure of the return oil exceeds a discharge pressure of the hydraulic pump, specifies a regenerating flow rate capable of being conducted to the regeneration oil passage and a surplus flow rate other than the regenerating flow rate, out of the return oil other than the return oil conducted to the tank through the supply and discharge adjusting section, on the basis of power required of the hydraulic pump, then conducts the return oil of the regenerating flow rate to the regeneration oil passage and controls the distribution flow rate adjusting means so that the return oil of the surplus flow rate is conducted to the outlet oil passage.

In this hydraulic drive device, during the external force applying period in which the return oil pressure exceeds the discharge pressure of the hydraulic pump, both regenerating flow rate capable of being conducted to the regeneration oil passage and surplus flow rate other than the regenerating flow rate are specified in advance and there is made a control for supplying only the return oil of the regenerating flow rate to the regenerating motor. According to this control, return oil of a flow rate larger than the flow rate of creating power required of the hydraulic pump is prevented from being supplied to the regenerating motor, that is, the discharge flow rate of the hydraulic pump is prevented from increasing to a greater extent than necessary. Consequently, it becomes possible to utilize the return oil effectively while maintaining the driven speed of the hydraulic actuator.

Preferably, for example in the case where a regeneratable power capable of being developed in the hydraulic pump by a regeneratable flow rate which is the flow rate of return oil in case of regeneration of return oil to the regenerating motor being not performed is not larger than a load power which is required of the regenerating motor for allowing the hydraulic pump to discharge a target flow rate, the control section sets a flow rate of not larger than the regeneratable flow rate as the regenerating flow rate.

When the regeneratable power capable of being developed by the return oil of the regenerable flow rate is smaller than the load power required of the regenerating motor, the control section can prevent the discharge flow rate of the hydraulic pump from exceeding the target flow rate, by setting a flow rate of not larger than the regeneratable flow rate as the regenerating flow rate.

Preferably, the distribution flow rate adjusting means includes a tilt adjusting section, the tilt adjusting section being able to adjust the tilt of the regenerating motor so that the flow rate of return oil which the regenerating motor accepts becomes adjustable, and an outlet valve disposed in the outlet oil passage, and when the regeneratable flow rate is not larger than a maximum acceptable flow rate preset for the regenerating motor, the control section operates the tilt adjusting section so that the regeneratable flow rate becomes acceptable, and fully closes the outlet valve.

When the regeneratable flow rate is not larger than the maximum acceptable flow rate set for the tilt adjusting section, this control permits effective utilization of the whole of return oil by setting the regeneratable flow rate as the regenerating flow rate and fully closing the outlet valve (making the surplus flow rate zero).

On the other hand, preferably, when the regeneratable flow rate exceeds the maximum acceptable flow rate, the control section sets the maximum acceptable flow rate as the regenerating flow rate and sets, as the surplus flow rate, a flow rate obtained by subtracting the maximum acceptable flow rate from the regeneratable flow rate.

According to this control, the maximum acceptable flow rate out of the regeneratable flow rate is supplied to the regenerating motor, while the surplus flow rate can be conducted to the tank through the outlet valve, so that the supply of excessive return oil to the regenerating motor is prevented and hence it is possible to protect the regenerating motor.

When the regeneratable power exceeds the load power, the control section may set, as the regenerating flow rate, a flow rate of not larger than a required flow rate which is required of the regenerating motor for creating the load power.

Thus, when the regeneratable power exceeds the load power, that is, when the direct supply of return oil of the regeneratable flow rate to the regenerating motor would induce a greater power than necessary in the regenerating motor, if a flow rate of not larger than the required flow rate out of the regeneratable flow rate is set as the regenerating flow rate, a greater power than the load power is prevented from being developed in the regenerating power.

In this case, preferably, the distribution flow rate adjusting means includes a tilt adjusting section, the tilt adjusting section being able to adjust the tilt of the regenerating motor so that the flow rate of return oil which the regenerating motor accepts becomes adjustable, and an outlet valve disposed in the outlet oil passage, and when the required flow rate exceeds a maximum acceptable flow rate preset for the regenerating motor, the control section operates the tilt adjusting section so as to provide a maximum tilt of the regenerating motor which is defined by the maximum acceptable flow rate, and adjusts an opening area of the outlet valve so as to permit flowing of a flow rate obtained by subtracting the maximum acceptable flow rate from the regeneratable flow rate.

According to this structure, the maximum acceptable flow rate out of the regeneratable flow rate is supplied to the regenerating motor, while the other flow rate can be conducted to the tank through the outlet valve, so that the regenerating motor can be protected by preventing return oil of a flow rate exceeding the maximum acceptable flow rate from being supplied to the regenerating motor.

On the other hand, preferably, when the required flow rate is not larger than the maximum acceptable flow rate, the control section sets the required flow rate as the regenerating flow rate and sets, as the surplus flow rate, a flow rate obtained by subtracting the required flow rate from the regeneratable flow rate.

According to this control, since return oil of the required flow rate out of the regeneratable flow rate can be supplied to the regenerating motor, return oil of a surplus flow rate can be conducted to the tank through the outlet valve while supplying the regenerating motor with return oil of a flow rate which is required of the regenerating motor.

The present invention further provides a working machine with the hydraulic drive device described above and a working attachment, wherein the hydraulic actuator includes a hydraulic cylinder for actuating the working attachment, and during an external force applying period in which the pressure of return oil discharged from the hydraulic cylinder under application thereto of the own weight of the working attachment exceeds the pressure of working oil supplied to the hydraulic cylinder, the control section specifies a regenerating flow rate capable of being conducted to the regeneration oil passage and a surplus flow rate other than the regenerating flow rate, out of the return oil, on the basis of power required of the hydraulic pump, then conducts the return oil of the regenerating flow rate to the regeneration oil passage and controls the distribution flow rate adjusting means so that the return oil of the surplus flow rate is conducted to the outlet oil passage.

In this working machine, during the external force applying period in which the pressure of return oil exceeds the discharge pressure of the hydraulic pump, a regenerating flow rate capable of being conducted to the regeneration oil passage and a surplus flow rate other than the regenerating flow rate are specified in advance and only the return oil of the regenerating flow rate is supplied to the regenerating motor, thereby the return oil of a flow rate larger than the flow rate of creating power required of the hydraulic pump is prevented from being supplied to the regenerating motor.

More specifically, in a working machine having a working attachment, a force (the own weight of the working attachment) acting in a direction to lower the working attachment is applied constantly to a hydraulic cylinder, so that during a lowering work period, the pressure of return oil discharged from the hydraulic cylinder becomes higher than that of working oil supplied to the hydraulic cylinder (there occurs an external force applying period). However, the present invention makes it possible to effectively utilize the return oil discharged from the hydraulic cylinder during the period.

The present invention further provides a working machine with the hydraulic drive device described above and a rotating body, wherein the hydraulic actuator includes a hydraulic motor for driving the rotating body, and during an external force applying period in which the pressure of return oil discharged from the hydraulic motor under application thereto of an inertia force of the rotating body based on a rotation driving exceeds the pressure of working oil supplied to the hydraulic motor, the control section specifies a regenerating flow rate capable of being conducted to the regeneration oil passage and a surplus flow rate other than the regenerating flow rate, out of the return oil, on the basis of power required of the hydraulic pump, then conducts the return oil of the regenerating flow rate to the regeneration oil passage and controls the distribution flow rate adjusting means so that the return oil of the surplus flow rate is conducted to the outlet oil passage.

According to this working machine, the inertia force of the rotating body acting in the direction of the rotation driving is applied constantly to the hydraulic motor, therefore, during the rotating operation period, the pressure of the working oil discharged from the hydraulic motor becomes higher than that of the working oil supplied to the hydraulic motor (there occurs an external force applying period). However, the present invention makes it possible to effectively utilize the return oil from the hydraulic motor during this period.

The present invention further provides a hydraulic drive device with a hydraulic pump driven by an engine, a control valve for supplying oil discharged from the hydraulic pump as an oil pressure source to a hydraulic actuator, and operating means for operating the control valve, the hydraulic drive device, including a variable capacity type regenerating motor, the regenerating motor being connected to the engine and driven with oil discharged from the hydraulic actuator to regenerate the energy of the oil as an engine assisting force, pressure detecting means for detecting the pressure on an upstream side of the regenerating motor, and control means adapted to receive the pressure detected by the pressure detecting means and make a vibration damping control to increase the capacity of the regenerating motor when the pressure rises or perform the degree of opening of a meter-out valve (a valve for controlling the amount of oil bypassing the regenerating motor and returning to a tank out of the oil discharged from the hydraulic actuator) when the pressure rises.

According to the above vibration damping control, the amount of oil discharged from the actuator is increased when the pressure rises, while it is decreased when the pressure drops, thereby it is possible to quickly damp pressure vibration of a hydraulic actuator circuit (e.g., a boom cylinder circuit or a rotating motor circuit).

Besides, the vibration damping control which utilizes the regenerating motor and the meter-out valve does not require the addition of hydraulic device and circuit for vibration damping and makes it possible to obtain a reliable vibration damping effect with use of a simple circuit configuration of a low cost.

In the case of a hydraulic actuator on which pressure (a steady pressure; holding pressure in the case of a boom cylinder) acts always in one direction, like a boom cylinder, the detected pressure is the above steady pressure plus vibration pressure (vibration component). In this case, if the control means determines a target capacity of the regenerating motor from a target flow rate of the oil discharged from the actuator which is proportional to the operation amount of the operating means, then adds the pressure based on vibration component out of the pressure detected by the pressure detecting means to the target capacity, thereby determining a final value of the target capacity, and then performs a vibration damping control based on the final value, this control is a feedback control with vibration component added out of the detected pressure, so that it becomes possible to effect a more accurate vibration clamping control according to vibration conditions and hence possible to enhance the vibration damping effect.

The invention claimed is:

1. A hydraulic drive device including a hydraulic pump and a hydraulic actuator, the hydraulic actuator being supplied with working oil from the hydraulic pump and being operated by discharging the working oil present in the interior thereof, the hydraulic drive device, comprising:

a regenerating motor, said regenerating motor being connected to the hydraulic pump so as to be able to drive the hydraulic pump and being driven by being supplied with the working oil from the hydraulic pump;

a supply and discharge circuit, said supply and discharge circuit including a supply oil passage for supplying the working oil from the hydraulic pump to the hydraulic actuator, a return oil passage for conducting return oil discharged from the hydraulic actuator to a tank, and a supply and discharge adjusting section capable of adjusting the flow rate of working oil flowing through said supply oil passage and that of the working oil flowing through said return oil passage simultaneously;

an outlet oil passage branching from said return oil passage so as to conduct the return oil to a tank without going through said supply and discharge adjusting section;

a regeneration oil passage for conducting the return oil to said regenerating motor without going through said supply and discharge adjusting section;

distribution flow rate adjusting means capable of adjusting the flow rate of the return oil flowing through said outlet oil passage and that of the return oil flowing through said regeneration oil passage; and a control section which, during an external force applying period in which the pressure of the return oil exceeds a discharge pressure of the hydraulic pump, specifies a regenerating flow rate capable of being conducted to said regeneration oil passage and a surplus flow rate other than the regenerating flow rate, out of the return oil other than the return oil conducted to said tank through said supply and discharge adjusting section, on the basis of power required of the hydraulic pump, then conducts the return oil of the regenerating flow rate to said regeneration oil passage and controls said distribution flow rate adjusting means so that the return oil of the surplus flow rate is conducted to said outlet oil passage.

2. The hydraulic drive device according to claim 1, wherein, in the case where a regeneratable power capable of being developed in the hydraulic pump by a regeneratable flow rate which is the flow rate of return oil in case of regeneration of return oil to said regenerating motor being not performed is not larger than a load power which is required of said regenerating motor for allowing the hydraulic pump to discharge a target flow rate, said control section sets a flow rate of not larger than the regeneratable flow rate as the regenerating flow rate.

3. The hydraulic drive device according to claim 2, wherein said distribution flow rate adjusting means includes a tilt adjusting section, said tilt adjusting section being able to adjust the tilt of said regenerating motor so that the flow rate of return oil which said regenerating motor accepts becomes adjustable, and an outlet valve disposed in said outlet oil passage, and when the regeneratable flow rate is not larger than a maximum acceptable flow rate preset for said regenerating motor, said control section operates said tilt adjusting section so that the regeneratable flow rate becomes acceptable, and fully closes said outlet valve.

4. The hydraulic drive device according to claim 3, wherein when the regeneratable flow rate exceeds the maximum acceptable flow rate, said control section sets the maximum acceptable flow rate as the regenerating flow rate and sets, as the surplus flow rate, a flow rate obtained by subtracting the maximum acceptable flow rate from the regeneratable flow rate.

5. The hydraulic drive device according to claim 2, wherein when the regeneratable power exceeds the load power, said control section sets, as the regenerating flow rate, a flow rate of not larger than a required flow rate which is required of said regenerating motor for creating the load power.

6. The hydraulic drive device according to claim 5, wherein said distribution flow rate adjusting means includes a tilt adjusting section, said tilt adjusting section being able to adjust the tilt of said regenerating motor so that the flow rate of return oil which said regenerating motor accepts becomes adjustable, and an outlet valve disposed in said outlet oil passage, and when the required flow rate exceeds a maximum acceptable flow rate preset for said regenerating motor, said control section operates said tilt adjusting section so as to provide a maximum tilt of said regenerating motor which is defined by the maximum acceptable flow rate, and adjusts an opening area of said outlet valve so as to permit flowing of a flow rate obtained by subtracting the maximum acceptable flow rate from the regeneratable flow rate.

7. The hydraulic drive device according to claim 6, wherein when the required flow rate is not larger than the maximum acceptable flow rate, said control section sets the required flow rate as the regenerating flow rate and sets, as the surplus flow rate, a flow rate obtained by subtracting the required flow rate from the regeneratable flow rate.

8. A working machine with the hydraulic drive device described in claim 1 and a working attachment, wherein the hydraulic actuator comprises a hydraulic cylinder for actuating said working attachment, and during an external force applying period in which the pressure of return oil discharged from said hydraulic cylinder under application thereto of the own weight of said working attachment exceeds the pressure of working oil supplied to said hydraulic cylinder, said control section specifies a regenerating flow rate capable of being conducted to said regeneration oil passage and a surplus flow rate other than the regenerating flow rate, out of the return oil, on the basis of power required of the hydraulic pump, then conducts the return oil of the regenerating flow rate to said regeneration oil passage and controls said distribution flow rate adjusting means so that the return oil of the surplus flow rate is conducted to said outlet oil passage.

9. A working machine with the hydraulic drive device described in claim 1 and a rotating body, wherein the hydraulic actuator comprises a hydraulic motor for driving said rotating body, and during an external force applying period in which the pressure of return oil discharged from said hydraulic motor under application thereto of an inertia force of said rotating body based on a rotation driving exceeds the pressure of working oil supplied to said hydraulic motor, said control section specifies a regenerating flow rate capable of being conducted to said regeneration oil passage and a surplus flow rate other than the regenerating flow rate, out of the return oil, on the basis of power required of the hydraulic pump, then conducts the return oil of the regenerating flow rate to said regeneration oil passage and controls said distribution flow rate adjusting means so that the return oil of the surplus flow rate is conducted to said outlet oil passage.

10. A hydraulic drive device with a hydraulic pump driven by an engine, a control valve for supplying oil discharged from the hydraulic pump as an oil pressure source to a hydraulic actuator, and operating means for operating the control valve, the hydraulic drive device, comprising:

a variable capacity type regenerating motor, said regenerating motor being connected to the engine and driven with oil discharged from the hydraulic actuator to regenerate the energy of the oil as an engine assisting force;

pressure detecting means for detecting the pressure on an upstream side of said regenerating motor;

operation amount detecting means for detecting the operation amount of the operating means; and control means adapted to receive an input of the pressure detected by said pressure detecting means and the operation amount of the operating means detected by said operation amount detecting means, wherein said control means determines a target capacity of said regenerating motor from a target flow rate of oil discharged from the hydraulic actuator according to the operation amount of the operating means, determines a final value of the target capacity by increasing the target capacity of said regenerating motor based on the pressure detected by said pressure detecting means when the pressure rises, and makes a vibration damping control to control said regenerating motor on the basis of the final value.

11. The hydraulic drive device according to claim 10 wherein said control means determines the target capacity of said regenerating motor from the target flow rate of the oil discharged from the hydraulic actuator which is proportional to the operation amount of the operating means, then adds to the target capacity the pressure based on a vibration component out of the pressure detected by said pressure detecting means, thereby determining the final value of the target capacity, and makes the vibration damping control based on the final value.

12. The hydraulic drive device according to claim 10, wherein said control means makes a vibration damping control for a hydraulic circuit of a boom cylinder which is for raising and lowering a boom of an excavating attachment attached to an upper rotating body mounted rotatably on a lower traveling body of a hydraulic working machine.

13. The hydraulic drive device according to claim 10, wherein said control means makes a vibration damping control for a hydraulic circuit of a rotating motor which is for driving and rotating an upper rotating body mounted rotatably on a lower traveling body of a hydraulic working machine.

14. A hydraulic drive device with a hydraulic pump driven by an engine, a control valve for supplying oil discharged from the hydraulic pump as an oil pressure source to a hydraulic actuator, and operating means for operating the control valve, the hydraulic drive device, comprising:

a variable capacity type regenerating motor, said regenerating motor being connected to the engine and driven with oil discharged from the hydraulic actuator to regenerate the energy of the oil as an engine assisting force;

a meter-out valve for controlling the amount of oil bypassing said regenerating motor and returning to a tank out of the oil discharged from the hydraulic actuator;

pressure detecting means for detecting the pressure on an upstream side of said regenerating motor;

operation amount detecting means for detecting the operation amount of the operating means; and control means adapted to receive an input of the pressure detected by said pressure detecting means and the operation amount of the operating means detected by said operation amount detecting means, wherein said control means determines a target capacity of said regenerating motor from a target flow rate of oil discharged from the hydraulic actuator according to the operation amount of the operating means, determines a final value of the target capacity by increasing the target capacity of said regenerating motor based on the pressure detected by said pressure detecting means when the pressure rises and controls said regenerating motor on the basis of the final value, or said control means increases the degree of opening of said meter-out valve when the pressure rises.

* * * * *

UNITED STATES PATENT AND TRADEMARK OFFICE

CERTIFICATE OF CORRECTION

PATENT NO. : 8,336,305 B2
APPLICATION NO. : 12/447347
DATED : December 25, 2012
INVENTOR(S) : Yuuji Matsuura et al.

It is certified that error appears in the above-identified patent and that said Letters Patent is hereby corrected as shown below:

On the title page, Item (54) and column 1 in the specification, the title is incorrect. Item (54) and column 1 should read:

--HYDRAULIC DRIVE DEVICE AND WORKING MACHINE HAVING THE SAME--

Signed and Sealed this
Second Day of April, 2013

Teresa Stanek Rea
*Acting Director of the United States Patent and Trademark Office*